United States Patent [19]

Jaggi et al.

[11] 4,279,055

[45] Jul. 21, 1981

[54] FILM PROCESSING INVOLVING NOXIOUS SUBSTANCE REMOVAL

[75] Inventors: Hans Jaggi, Ardsley; Pat Mathison, Larchmont; Paul DeBartolo, New Rochelle, all of N.Y.

[73] Assignee: PES Photographic Equipment Service Inc., New Rochelle, N.Y.

[21] Appl. No.: 184,892

[22] Filed: Sep. 8, 1980

[51] Int. Cl.[3] ..... B08B 5/02

[52] U.S. Cl. ..... 15/302; 15/306 A; 352/130; 355/30

[58] Field of Search ..... 352/130, 194, 222; 355/30; 354/317, 323; 15/100, 302, 306 A

[56] References Cited

U.S. PATENT DOCUMENTS

| | | | |
|---|---|---|---|
| 2,956,301 | 10/1960 | Bruno | 15/306 A |
| 3,158,886 | 12/1964 | Grimes | 15/100 |
| 3,776,626 | 12/1973 | Lewis | 352/194 |
| 4,202,073 | 5/1980 | Hughes | 15/306 A |

*Primary Examiner*—L. T. Hix
*Assistant Examiner*—Alan Mathews
*Attorney, Agent, or Firm*—Michael J. Striker

[57] ABSTRACT

A device for removing volatile noxious liquids from photographic film has a film passage with an inlet and an outlet. Inwardly adjacent the film passage the opposite surfaces of the passage have recesses which are connected to a suction source; the inlet is slightly larger than the film so that the suction can act already on the film before the same enters the inlet, so that vapors forming outside the inlet are aspirated by the suction. A portion of the adhering liquid is also removed by this suction. Subsequently the device has in these surfaces two additional recesses which are also connected to a suction source, to remove additional liquid. Downstream of these additional recesses a series of air outlet openings is provided in each of the surfaces; these openings face in upstream direction and receive air under sufficient pressure so that any liquid still adhering after the web passes the additional recesses is forced to flow in upstream direction and to the additional recesses, to be aspirated by the suction therein, while the air at the same time dries the film which then emerges from the device in dry condition.

12 Claims, 6 Drawing Figures

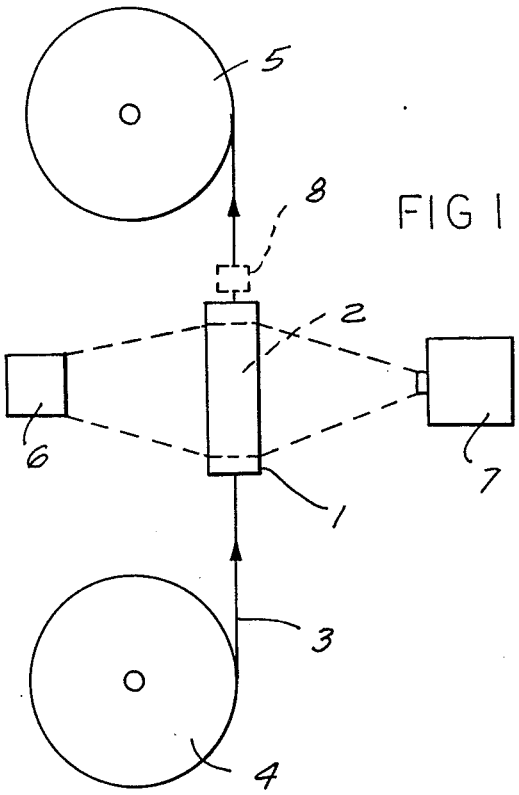
FIG 1
FIG 6
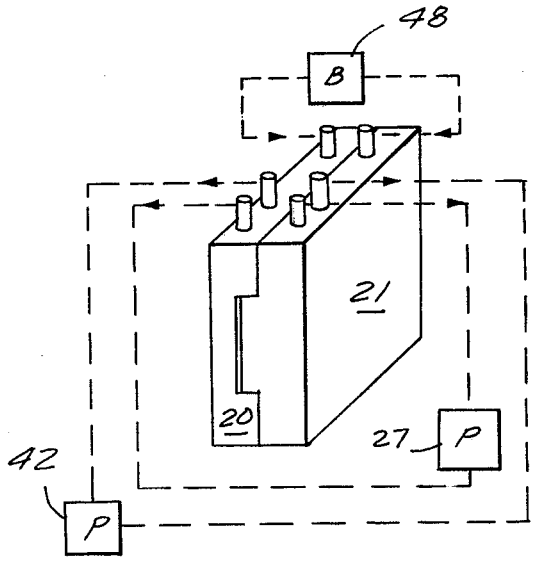

FILM PROCESSING INVOLVING NOXIOUS SUBSTANCE REMOVAL

BACKGROUND OF THE INVENTION

This invention relates to the processing of photographic film.

More particularly, the invention relates to film processing apparatus.

When photographic film is printed, certain liquids are used which are capable of releasing noxious fumes. This is particularly true of the "wet gate" film printing method with reference to which the invention will hereinafter be described without, however, being limited thereto.

It is known to copy a "master" film by passing it through an apparatus in which each film frame is exposed in a film gate and—while so exposed—is photographed onto another film (the copy). Photographic emulsions are highly sensitive to physical damage and are therefore easily scratched. If there is a scratch on the master, this will be faithfully reproduced (photographically) on the copy which, needless to say, is undesirable. To overcome this problem, the socalled "wet gate printing" technique was developed.

In wet gate printing the master film passes through a film gate having two clear glass windows between which a liquid is entrapped. This liquid has a light refractive index which is the same as that of the film. It fills any scratches in the emulsion and makes them "invisible" to the camera which photographs the images of the master onto the copy film. Moreover, the presence of this liquid was found to confer additional benefits in terms of enhancing the quality of the copies made, for reasons known to those skilled in the art, and wet gate printing is now the industry-accepted manner of copying a master film.

The liquid used in wet gate printing is perchlorethylene, a fluid which, when it emerges into the atmosphere on the film coming out of the wet gate, turns into a noxious vapor. While the presence of these fumes is unpleasant in itself, there is now a suspicion that they may have a carcinogenic effect. This, of course, takes the matter out of the realm of being merely a nuisance and requires appropriate corrective action.

SUMMARY OF THE INVENTION

Accordingly, it is a general object of the invention to overcome the prior-art difficulties.

A more particular object is to provide improved film processing apparatus which avoids the aforementioned problems.

Still more specifically, it is an object of the invention to provide film processing apparatus capable of removing liquid a adhering to a film being processed—the term process is used herein to include passage of a film through a wet gate—and to prevent the evolution of vapors or fumes from such (highly volatile) liquid.

In keeping with these objects, and with still others which will become apparent hereafter, one feature of the invention resides in a device for processing webs, comprising wall means defining a web passage having an inlet and an outlet; first means for applying to opposite major surfaces of a web in the region of said inlet a suction sufficient to remove a portion of a noxious substance on the web; second means intermediate said first means and said outlet for applying to said opposite major surfaces of the web additional suction to remove another portion of the noxious substance; and third means in the region of said outlet for applying to said opposite major surfaces pressurized air flowing in direction towards said second means, so as to force residual noxious substance to the vicinity of said second means for aspiration thereby.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a diagrammatic side elevation, showing a film copying arrangement using a wet gate;

FIG. 6 is a diagrammatic illustration, showing the device of FIGS. 1-5 with its associated fluid circuitry.

DESCRIPTION OF PREFERRED EMBODIMENTS

Figure 2:
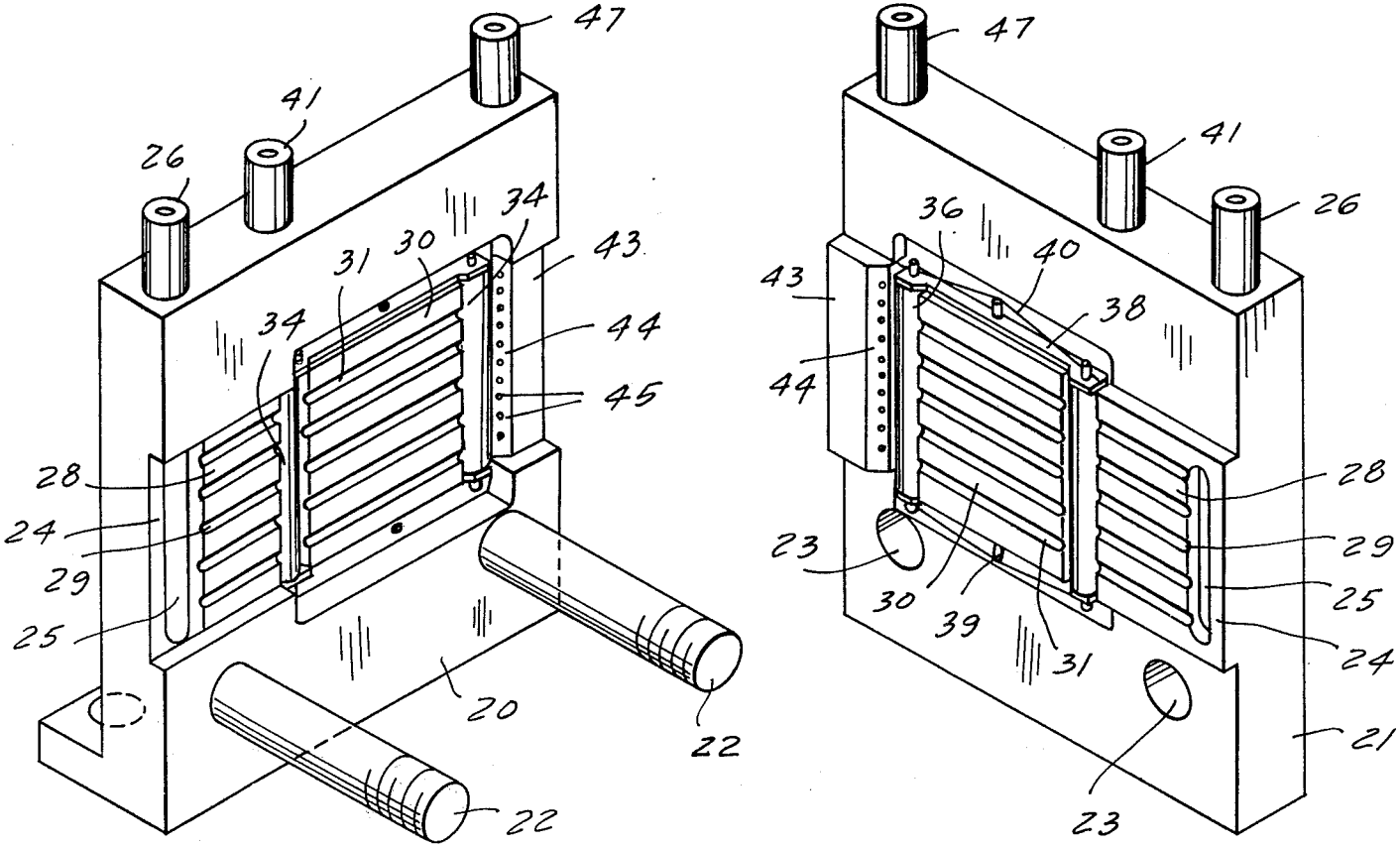
FIG. 2 is an exploded perspective, showing a device according to the present invention.
Figure 3:
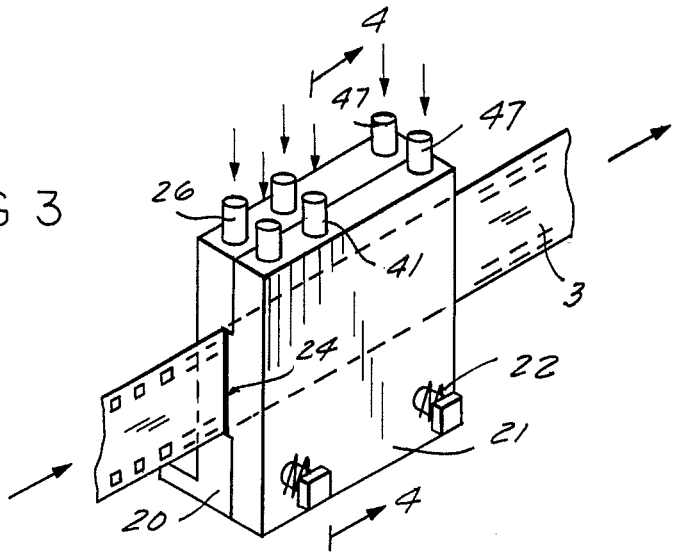
FIG. 3 is a perspective view, showing the device of FIG. 2 in assembled operating condition.
Figure 4:
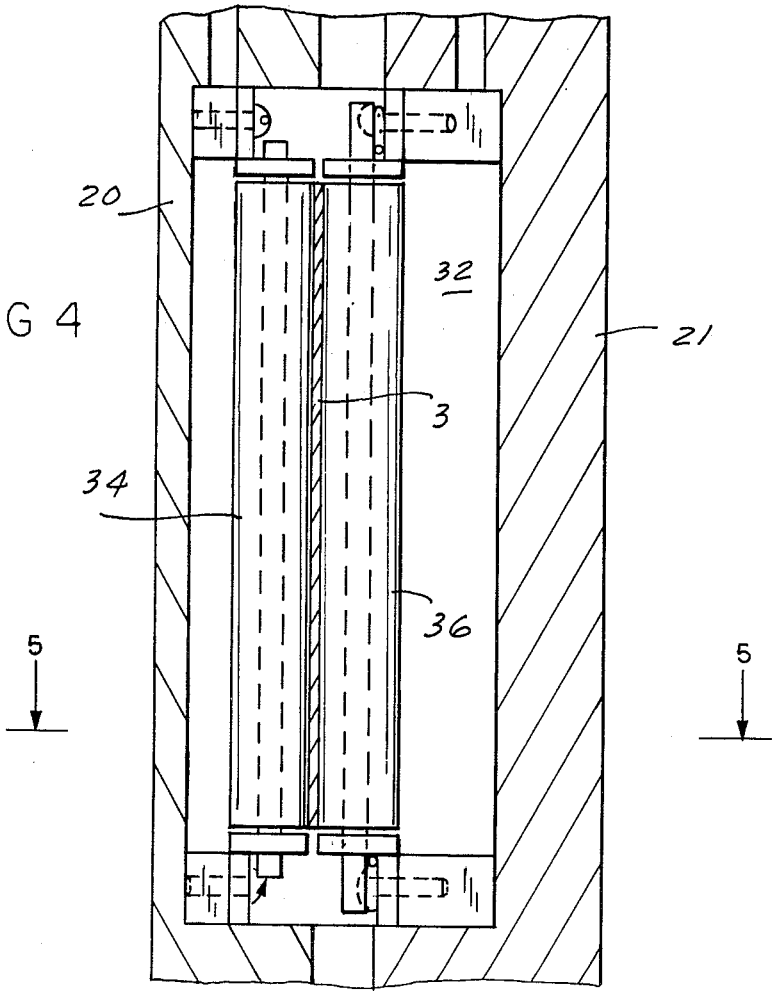
FIG. 4 is a vertical section, taken on line 4—4 of FIG. 3.

Referring now to the drawing in detail, and firstly to FIG. 1 thereof, it will be seen that this Figure shows a wet-gate printing (copying) arrangement in a side elevational view.

A master film 3 to be copied is pulled off a supply reel 4 and advanced in the direction indicated by the arrows, i.e. upwardly, to be taken up onto a take-up reel 5. The direction of movement could be opposite, but upward movement is the most common in the industry. The moving film passes through the diagrammatically illustrated wet gate 1 (known per se from U.S. Pat. No. 3,777,626 which is incorporated herein by reference). The wet gate 1 has a film window 2 in which the film frames of film 3 are successively exposed to view. Light from a light source (known per se) is directed through the thus exposed film frames from one side, and a motion-picture camera 7 (known per se and therefore shown only diagrammatically) photographs each exposed film frame onto a motion picture film. In this manner, copies or duplicates are made from the master film.

For the reasons described hereinbefore and developed more fully in the aforementioned U.S. Pat. No. 3,776,626, the film 3 passes in the wet gate through a liquid (hence the name "wet" gate) which forms a liquid layer at each major surface of the film. This liquid is usually perchlorethylene, now suspected of having a carcinogenic effect, as also outlined earlier herein. In view of the delicacy of the photographic emulsion on the film 3 it has proven to be impossible to strip the liquid from the film before the same moves out of the wet gate 1. Consequently, liquid adheres to the film emerging from the wet gate and, being highly volatile, immediately or almost immediately becomes converted to vaporous state in which it is now believed to have its carcinogenic effect.

It is this release of vapors which the present invention seeks to avoid, by placing the device 8 according to the invention (shown only diagrammatically in FIG. 1) as closely adjacent to the film outlet of the wet gate 1 as possible.

Details of the device 8 are shown in FIGS. 2–5. The device is composed of two sections 20, 21 of which one has guide pins 22 or analogous members while the other has cooperating guide passages 23. The sections 20, 21 can therefore by moved between open and closed (FIG. 3) position by pushing and pulling. The length of pins 22 is greater than the thickness of section 21, so that they extend in part outwardly beyond the same; these parts may be threaded interiorly or exteriorly and nuts or screws with heads threaded onto them; helical springs surround the projecting parts and bear upon the respective nuts or screws and upon the outer surface of section 21. Thus, the two sections 20, 21 are releasably held together under a tension which can be adjusted by turning of the nuts or screws.

The juxtaposed inner surfaces of the sections 20, 21 define with one another on inlet slot 24 through which the wet film 3 enters after leaving the wet gate 1. Immediately inwardly of the inlet slot the inner surface of each section is provided with a recess 25 extending over substantially the entire width of the film 3; each of these recesses communicates via a bore (not shown) with a suction nipple 26 which are in turn connected to a vacuum pump 27 (FIG. 6) with a suction equivalent to about 10" mercury (of course, all numerical information herein is for explanation and not to be considered limiting).

Figure 5:
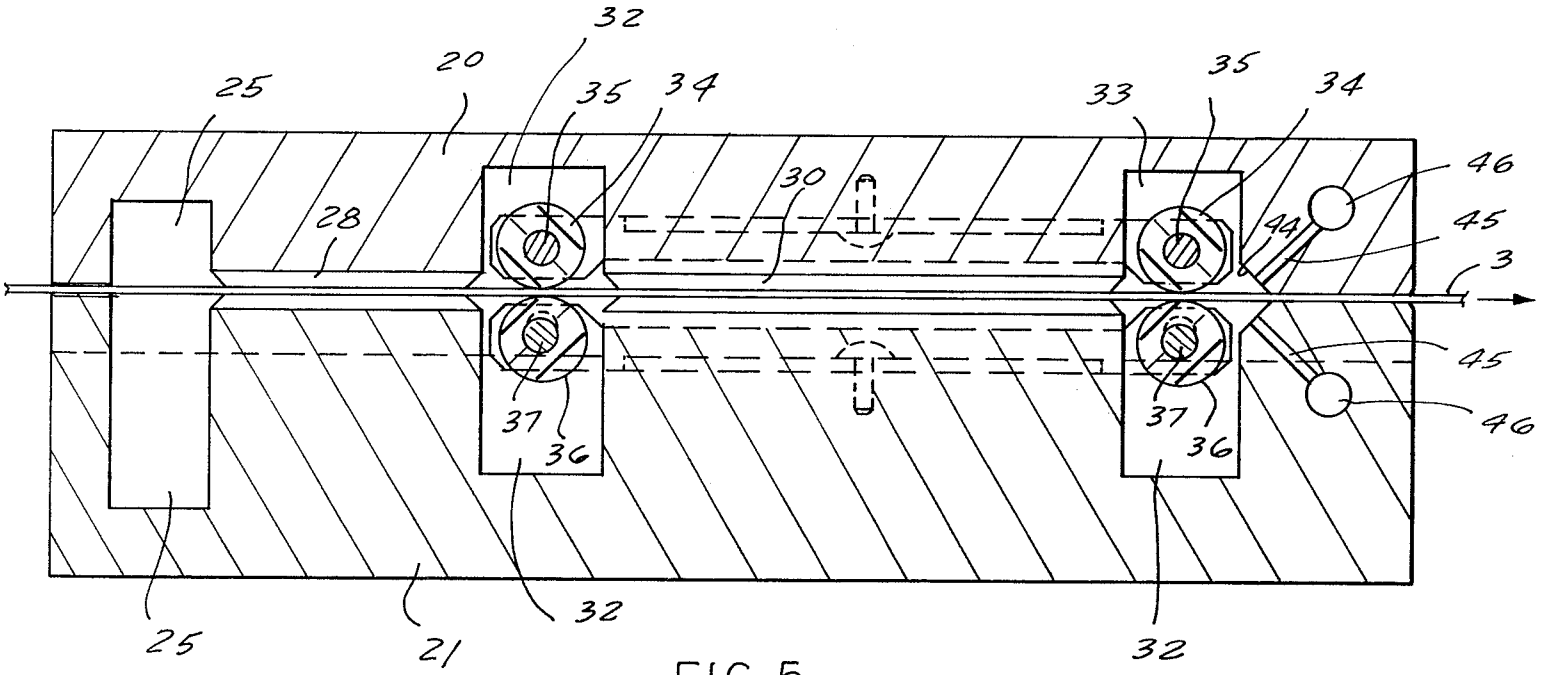
FIG. 5 is a horizontal section, taken on line 5—5 of FIG. 4.

Downstream of the recesses 25 (as considered in the direction of film movement) each section 20, 21 is provided with a surface portion 28 formed with grooves 29 extending in the direction of film movement, and further downstream thereof with another surface portion 30 formed with similar grooves 31. The surface portions 28 and 30 are separated by another recess 32 similar to the recess 25 and with which the grooves 29, 31 communicate (FIG. 5). Two further similar recesses 33 are provided in the respective sections 20, 21 at the downstream end of the surface portion 30. Journalled for rotation in these recesses of section 20 are rollers 34 which rotate about stationary axes 35; journalled in the recesses of section 21 are similar rollers 36. These, however, rotate about axes 37 which have some freedom of movement towards and away from the plane in which the film 3 moves through the device (FIG. 5). The rollers 36 are mounted in a frame 38 which carries the axes 37 and is installed in an appropriate space of section 21; it has pins 39 which are engaged by springs 40 which bias the frame 38 (and thus the axes 37) towards the film plane. The rollers 34, 36 thus engage the opposite major surfaces of the film 3 and form therewith a seal. The recesses 32 communicate via bores in sections 20, 21 with suction nipples 41 which are connected to another vacuum pump 42 of e.g. the same suction capacity as the pump 27 (FIG. 6).

At the downstream end of the surface portions 30, beyond the recesses 33 but ahead of the surface portions 43 which together bound the outlet for the film 3, each section is provided with an inclined surface portion 44 which faces towards the rollers 36. Each of these surface portions 44 is provided with a plurality (at least one row) of bores 45 extending inwardly from it and communicating with respective passages 46 leading to nipples 47 which, as shown in FIG. 6, are connected to a blower or analogous device 48 that supplies air at a pressure of about 25 psi.

In operation of the device, the suction of pump 27 acts via recess 25 upon the film 3 entering the device. The dimension of the film inlet 24 is purposely made somewhat wider than the film thickness, so that the suction can actually penetrate outwardly beyond the film inlet 24 and already act in the region ahead of the same. The purpose of this—and of placing device 8 as close as possible to the outlet of the wet gate 1—is to aspirate the vapors at the earliest possible moment, i.e. as soon as they begin to evolve as the liquid on the film leaves the wet gate and becomes exposed to the atmosphere. In this manner it is possible to aspirate all or substantially all of the evolving vapors through inlet 24. Besides doing that, the suction from pump 27 also removes the major portion of the liquid adhering to the film and withdraws it from the device 8 (the liquid may be collected in known manner in a receptacle for reuse).

Residual liquid is removed from the film 3 by the suction from pump 42 which acts in the recesses 32. This removal of the remaining liquid is aided, and drying of the film 3 prior to its exit through the outlet defined by surface portions 43 is accomplished, by the air blown by blower 48 through the bores 44. These are so angled that the air issuing from them passes beneath rollers 34, 36 in recesses 33 and flows along the grooves 30 towards the recesses 32. The force of the air is such that any residual liquid still adhering to the film after it passes beyond the rollers 34, 36 in the recesses 32, is forced along the grooves 30 to the recesses 32, where it is withdrawn by the suction of pump 42.

The film 3 leaves the outlet bounded by the surface portions 43 in dry condition, with no further possibility of vapor formation being present. The invention thus solves the problem outlined in the introductory description, since it withdraws any vapors that might evolve before the film enters the device 8 and precludes the development of vapors after the film leaves the device.

Various modifications are, of course, possible since the illustrated embodiment is for purposes of explanation only. For example, the nipples 26 and 41 could be connected to a common vacuum pump of requisite capacity. The rollers may be of steel, rubber or synthetic plastic material. Also, the invention could be utilized for purposes other than in connection with wet gate film printing.

While the invention has been illustrated and described as embodied in a film processing context, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for processing webs, particularly photographic films, carrying a noxious substance which must be removed therefrom, comprising wall means defining a web passage having an inlet and an outlet; first means for applying to opposite major surfaces of a web in the region of said inlet a suction sufficient to remove a portion of a noxious substance on the web; second means intermediate said first means and said outlet for applying to said opposite major surfaces of the web additional suction to remove another portion of the noxious substance; and third means in the region of said outlet for applying to said opposite major surfaces pressurized air flowing in direction towards said second means, so as to force residual noxious substance to the vicinity of said second means for aspiration thereby.

2. A device as defined in claim 1, wherein the noxious substance is a volatile liquid and said third means dries said opposite major surfaces concomitantly with forcing residual liquid to the vicinity of said second means.

3. A device as defined in claim 2, said inlet having dimensions which are at least in part in excess of those of the entering web, so that suction from said first means can act outwardly beyond said inlet and aspirate vapors given off by said volatile liquid.

4. A device as defined in claim 1, said wall means comprising two wall sections having respective juxtaposable surfaces which between themselves define said web passage.

5. A device as defined in claim 4, said first means including in each of said surfaces inwardly adjacent said inlet a recess extending across the path of movement of the web, and means for connecting the respective recesses to a source of suction.

6. A device as defined in claim 5, said second means including in each of said surfaces intermediate said first and second means another recess extending across the path of movement of the web, and means for connecting the respective other recess to a source of suction.

7. A device as defined in claim 6, said second means further including in each of said surfaces an additional recess ahead of but proximal to said third means and also extending across the path of web movement, said third means discharging air into said additional recesses counter to the direction of web movement.

8. A device as defined in claim 7, said surfaces each including a surface portion extending lengthwise of said path of web movement between said other and additional recesses of said second means and being provided with a set of grooves also extending lengthwise of said path and communicating with the respective other and additional recesses.

9. A device as defined in claim 8, said surfaces further each including another surface portion and set of grooves similar to the first-mentioned ones and extending between and communicating the first-mentioned recesses and said other recesses.

10. A device as defined in claim 8; and further comprising a set of rollers in said recesses of said second means in each of said surfaces.

11. A device as defined in claim 10; and further comprising means resiliently biasing the rollers of at least one of said sets towards the rollers of the other set, for sealing engagement of the roller of the respective sets with said opposite major surfaces of the web.

12. A device as defined in claim 8, said third means including in each of said surfaces a surface portion extending across the path of web movement and provided with a plurality of air outlet openings communicating with a source of air under pressure and inclined so as to discharge into the respective additional recess, so that the air passes therefrom into said grooves and moves along the same to the respective other recess, taking along residual noxious substance and drying the web.

* * * * *